US012225930B2

(12) United States Patent
Lavanchy et al.

(10) Patent No.: US 12,225,930 B2
(45) Date of Patent: Feb. 18, 2025

(54) AEROSOL-GENERATING ARTICLE WITH NARROW HOLLOW TUBULAR FILTER

(71) Applicant: Philip Morris Products S.A., Neuchatel (CH)

(72) Inventors: Frederic Lavanchy, Chavornay (CH); Michel Bessant, Neuchatel (CH); Silviu Natanael Pantea, Neuchatel (CH); Johannes Petrus Maria Pijnenburg, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 744 days.

(21) Appl. No.: 17/298,840

(22) PCT Filed: Dec. 4, 2019

(86) PCT No.: PCT/EP2019/083700
§ 371 (c)(1),
(2) Date: Jun. 1, 2021

(87) PCT Pub. No.: WO2020/115147
PCT Pub. Date: Jun. 11, 2020

(65) Prior Publication Data

US 2022/0030939 A1 Feb. 3, 2022

(30) Foreign Application Priority Data

Dec. 6, 2018 (EP) ..... 18210862

(51) Int. Cl.
*A24F 40/20* (2020.01)
*A24D 1/20* (2020.01)
(Continued)

(52) U.S. Cl.
CPC ..... *A24D 3/17* (2020.01); *A24D 1/20* (2020.01); *A24D 3/062* (2013.01); *A24F 40/20* (2020.01)

(58) Field of Classification Search
CPC . A24D 3/17; A24D 1/20; A24D 3/062; A24D 3/0279; A24D 3/0291; A24D 1/045;
(Continued)

(56) References Cited

U.S. PATENT DOCUMENTS 2,954,783 A * 10/1960 Lebert ..... A24F 13/06 131/201
4,413,641 A * 11/1983 Dwyer, Jr. ..... A24D 3/045 131/330
(Continued)

FOREIGN PATENT DOCUMENTS

EP 2 797 445 A1 11/2014
EP 2 863 765 A1 4/2015
(Continued)

OTHER PUBLICATIONS

Combined Russian Office Action and Search Report dated Dec. 3, 2021 in Russian Patent Application No. 2021119559 (submitting English translation only), 5 pages.
(Continued)

*Primary Examiner* — Truc T Nguyen
(74) *Attorney, Agent, or Firm* — Oblon, McClelland, Maier & Neustadt, L.L.P.

(57) ABSTRACT

An aerosol-generating article is provided, including: a substrate portion containing aerosol-forming substrate; and a hollow tubular filter portion having an inner diameter of between 0.5 millimeters and 2 millimeters, and the aerosol-forming substrate including at least one aerosol-former selected from the group consisting of: polyhydric alcohols, esters of polyhydric alcohols, and aliphatic esters of mono-,
(Continued)

Figure 1:
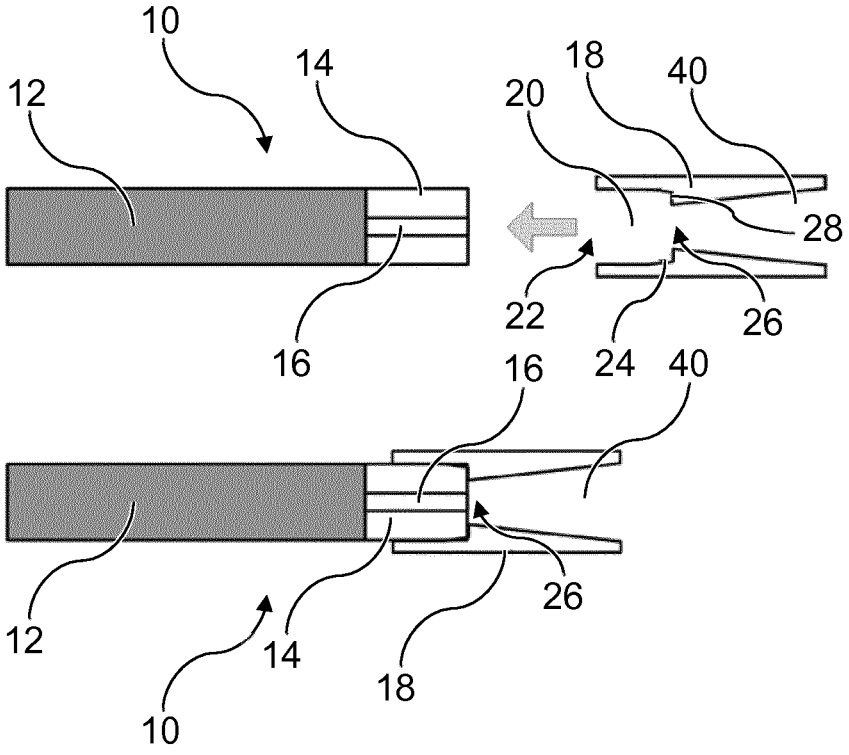

di-, or polycarboxylic acids. A system for generating an aerosol is also provided, including an aerosol-generating device including a heating chamber and a heating element; and the aerosol-generating article, the aerosol-generating article being configured to be insertable into the heating chamber.

16 Claims, 2 Drawing Sheets

(51) Int. Cl.
*A24D 3/06* (2006.01)
*A24D 3/17* (2020.01)

(58) Field of Classification Search
CPC ..... A24D 3/0287; A24D 3/10; A24F 40/20; A24F 40/46; A24B 15/167; A24B 15/32
See application file for complete search history.

(56) References Cited

U.S. PATENT DOCUMENTS

| | | | | |
|---|---|---|---|---|
| 4,517,996 | A * | 5/1985 | Vester | A24D 3/043 131/344 |
| 4,574,820 | A * | 3/1986 | Pinkerton | A24D 3/045 131/339 |
| 4,582,072 | A * | 4/1986 | Sanford | A24D 3/043 131/344 |
| 4,942,887 | A * | 7/1990 | Abdelgawad | A24D 3/043 131/339 |
| 4,949,736 | A * | 8/1990 | Roberts | A24D 3/041 131/198.1 |
| 10,757,970 | B2 * | 9/2020 | Li | A61M 15/06 |
| 11,828,489 | B2 * | 11/2023 | Lindsay | F24F 8/108 |
| 12,035,742 | B2 * | 7/2024 | Lavanchy | A24D 1/18 |
| 2008/0216851 | A1 * | 9/2008 | Olegario | A24D 3/043 131/202 |
| 2014/0305449 | A1 | 10/2014 | Plojoux et al. | |
| 2015/0136154 | A1 | 5/2015 | Mitrev et al. | |
| 2015/0163859 | A1 | 6/2015 | Schneider et al. | |
| 2016/0165950 | A1 * | 6/2016 | Brown | A24D 1/045 131/345 |
| 2017/0086508 | A1 | 3/2017 | Mironov et al. | |
| 2017/0164659 | A1 | 6/2017 | Schneider et al. | |
| 2017/0325497 | A1 * | 11/2017 | Dincer | A24D 3/10 |
| 2018/0049471 | A1 | 2/2018 | Holoubek et al. | |
| 2018/0168231 | A1 * | 6/2018 | Reevell | A61M 15/06 |
| 2018/0168232 | A1 * | 6/2018 | Reevell | H05B 3/12 |
| 2018/0169355 | A1 * | 6/2018 | Reevell | A61M 11/042 |
| 2019/0150516 | A1 * | 5/2019 | Shenkal | A24F 40/485 |
| 2022/0030951 | A1 * | 2/2022 | Lavanchy | A24F 40/485 |
| 2022/0175022 | A1 * | 6/2022 | Papakyrillou | A24D 3/17 |

FOREIGN PATENT DOCUMENTS

| | | | | |
|---|---|---|---|---|
| EP | 3 145 338 | A1 | 3/2017 | |
| EP | 3 180 998 | A1 | 6/2017 | |
| EP | 3 253 236 | A1 | 12/2017 | |
| JP | 2017-519493 | A | 7/2017 | |
| KR | 10-2015-0097819 | A | 8/2015 | |
| KR | 10-2017-0008730 | A | 1/2017 | |
| RU | 2 668 750 | C1 | 10/2018 | |
| WO | WO 2013/060607 | A1 | 5/2013 | |
| WO | WO 2013/098395 | A1 | 7/2013 | |
| WO | WO 2013/190036 | A1 | 12/2013 | |
| WO | WO 2015/176898 | A1 | 11/2015 | |
| WO | WO 2016/124552 | A1 | 8/2016 | |
| WO | WO 2018/002269 | A1 | 1/2018 | |
| WO | WO 2019081602 | * | 5/2019 | A24F 40/20 |

OTHER PUBLICATIONS

Japanese Office Action dated Jul. 27, 2022 in Japanese Patent application No. 2021-531410 (with English translation), 5 pages.
Korean Office Action dated May 15, 2023 in Korean Patent Application No. 10-2021-7010122 (with English Translation), 10 pages.
Combined Chinese Office Action and Search Report dated Apr. 29, 2023 in Chinese Patent Application No. 201980067954.5 (with English translation), 14 pages.
Edited by Hubei Press Dictionary "Common Encyclopedia Dictionary" Published on Jul. 31, 1991, p. 144 (with cover page).
International Search Report and Written Opinion dated Mar. 2, 2020 in PCT/EP2019/083700 filed on Dec. 4, 2019.
Japanese Office Action mailed on Nov. 9, 2023 issued in Japanese Patent Application 2021-531410 filed on Dec. 4, 2019, total 2 pages (citing reference 15, therein).
Korean Office Action issued Jul. 4, 2024, in corresponding Korean Patent Application No. 10-2021-7010122 (with English Translation) citing document 15 herein, 4 pages.

* cited by examiner

AEROSOL-GENERATING ARTICLE WITH NARROW HOLLOW TUBULAR FILTER

The present invention relates to an aerosol-generating article comprising a substrate portion containing aerosol-forming substrate and a hollow tubular filter portion.

It is known to provide an aerosol-generating device for generating an inhalable aerosol. Such devices may heat aerosol-forming substrate contained in an aerosol-generating article without burning the aerosol-forming substrate. The aerosol-generating article may have a rod shape for insertion of the aerosol-generating article into a heating chamber of the aerosol-generating device. A heating element may be arranged in or around the heating chamber for heating the aerosol-forming substrate once the aerosol-generating article is inserted into the heating chamber of the aerosol-generating device. The mouthpiece may be provided at the end of the aerosol-generating article.

Known aerosol-generating articles are relatively complex and require multiple different portions such as a substrate portion, one or more filter portion and a cooling section for generating the inhalable aerosol, frequently requiring three to five segments or plugs in the aerosol-generating article that all need to be arranged into a rod shaped form. This requires complex making machinery and combining machinery.

It would be desirable to have an aerosol-generating article and a mouthpiece with reduced complexity. It would be further desirable that such an aerosol-generating article shows good aerosol generation characteristics.

According to a first aspect of the invention there is provided an aerosol-generating article comprising a substrate portion containing aerosol-forming substrate and a hollow tubular filter portion. The hollow tubular filter portion may have an inner diameter of below 5 millimeters.

A diameter of below 5 millimeters can have at least two distinct advantages. Where the diameter is between about 2 millimeters and 5 millimeters, a cavity is created at the downstream end of the aerosol-forming substrate. When the stream of material that is released from the aerosol-former substrate enters such an open space of the hollow tubular filter portion, this expansion cools down the stream to some extent and can aerosol droplets may form. In addition, this effect can be further enhanced to use a further reduction of diameter downstream of the cavity, for example with a mouthpiece as will be discussed further below.

However, it has been found that advantageously, the inner diameter of the hollow tubular filter portion is below 2 millimeters. At 2 millimeters or below, the inner diameter of the hollow tubular filter portion is smaller than the inner diameter of conventional hollow tubular filter portions of conventional aerosol-generating articles. Advantageously, this relatively small diameter may enable a venturi effect when combined with a subsequence structure with a larger diameter such as a further mouthpiece described below. Hence, the complexity of the aerosol-generating article may be reduced due to the fact that the number of elements of the aerosol-generating article may be advantageously reduced such as, for example, a cooling section for generating the aerosol. According to the invention, some of the functionality of the aerosol generating article can be transferred into the reusable mouthpiece. This means that elements that would be otherwise only used once can now be used multiple times. This means that the aerosol-generating articles can be simplified. This reduces the amount of waste from the single use articles that would be created otherwise.

Additionally, this relatively small diameter may result in a desired resistance to draw.

As used herein, the terms 'upstream' and 'downstream' are used to describe the relative positions of components, or portions of components, of the mouthpiece and the aerosol-generating article according to the invention in relation to the direction of air drawn through the mouthpiece and the aerosol-generating article during use thereof.

The hollow tubular filter portion of the aerosol-generating article may comprise for example a hollow acetate tube (HAT), a fine hollow acetate tube (FHAT) or a plug of tow wrapped around a central cardboard tube, all of which structures being known from manufacture of filter elements. The hollow tubular filter portion preferably comprises a hollow central space. The inner diameter of the hollow tubular filter portion may refer to the diameter of the hollow central space.

The hollow tubular filter portion may be located immediately downstream of the substrate portion containing the aerosol-forming substrate of the aerosol-generating article and may directly abut the aerosol-forming substrate. The aerosol-generating article may only comprise the substrate portion and the hollow tubular filter portion.

If desired or required, for example to achieve a sufficiently high resistance to draw of the aerosol-generating article, an additional filter section may be included in the aerosol-generating article. Preferably such additional filter section may be included between the substrate portion and the hollow tubular filter portion. Preferably, such additional filter section comprises a filtration material such as, for example, cellulose acetate. Preferably, the length of the additional filter section is between about 4 millimeters and about 8 millimeters, preferably, between about 5 millimeters and about 7 millimeters. Preferably, the combined length of the additional filter section and the hollow tubular filter portion is between about 10 millimeters and about 18 millimeters, preferably, 13 millimeters.

The hollow tubular filter portion may be formed from any suitable material or combination of materials. For example, the hollow tubular filter portion may be formed from one or more materials selected from the group consisting of: cellulose acetate; cardboard; paper, such as crimped heat resistant paper or crimped parchment paper; cotton; viscose; glass fibres; and other polymeric materials, such as low density polyethylene (LDPE). In a preferred embodiment, the hollow tubular filter portion is formed from cellulose acetate.

The hollow tubular filter portion preferably has an external diameter that is approximately equal to the external diameter of the aerosol-generating article.

The hollow tubular filter portion may have an external diameter of between approximately 4 millimeters and approximately 8 millimeters, for example of between approximately 5 millimeters and approximately 6 millimeters, preferably around 5.3 millimeters. The hollow tubular filter portion may have a length of between approximately 10 millimeters and approximately 14 millimeters.

The hollow tubular filter portion may have an inner diameter of between 0.5 millimeters and 2 millimeters, preferably between 0.75 millimeters and 1.25 millimeters, more preferably around 1 millimeter. Alternatively, the hollow tubular filter portion may have an inner diameter between 2 millimeters and 5 millimeters.

The aerosol-generating article may comprise a cylindrical filter portion arranged between the substrate portion and the hollow tubular filter portion.

The cylindrical filter portion may prevent aerosol-forming substrate such as tobacco from entering the hollow tubular filter portion, which may clog the hollow tubular filter portion. The cylindrical filter portion may further aid in removing unwanted constituents from the air containing vaporized aerosol-forming substrate drawn through the aerosol-generating article. Additionally, the cylindrical filter portion may be used to adjust the resistance to draw to a desired level. In case a cylindrical filter portion is provided, the total length of the cylindrical filter portion plus the hollow tubular filter portion may be between 10 millimeters and 13 millimeters. The cylindrical filter portion may have a length between 4 millimeters and 8 millimeters, preferably between 5 millimeters and 7 millimeters. According to this aspect, the hollow tubular filter portion may have a length between 5 millimeters and 9 millimeters. Most preferred the combined length of the cylindrical filter portion and the hollow tubular filter portion is 13 millimeters.

The invention also relates to a system comprising an aerosol-generating article as described above and a mouthpiece configured attachable to the aerosol-generating article. The aerosol-generating article with a hollow tubular filter portion with small diameter in conjunction with the mouthpiece may reduce complexity of the system as well as improve aerosol generation. The mouthpiece preferably is provided as a reusable mouthpiece.

The mouthpiece may comprise an upstream end with a cavity configured for enabling insertion of the aerosol-generating article into the cavity.

The cavity may be configured for securely holding the aerosol-generating article in the cavity and thus in connection with the mouthpiece. The cavity may be configured to tightly receive the aerosol-generating article so as to prevent leakage of one or more of air, vaporized aerosol-forming substrate and aerosol between the aerosol-generating article and the mouthpiece. A user may insert the aerosol-generating article into the cavity of the mouthpiece for usage. After the smoking experience, the user may remove the used aerosol-generating article from the cavity and insert a new aerosol-generating article into the cavity.

The cavity may comprise a conical section at a downstream side of the cavity, wherein an inner diameter of the cavity may decrease in the conical section in a downstream direction.

The conical section may be provided to reduce the diameter of the cavity so that an inserted aerosol-generating article is tightly received at the downstream end of the cavity. Preferably, the conical section is provided to contact the outer perimeter of the aerosol-generating article during insertion of the aerosol-generating article. The conical section may thus provide a tight connection between the downstream end of the conical section and the outer perimeter of the aerosol-generating article, thereby facilitating secure holding of the aerosol-generating article. Furthermore, a seal may be provided by the downstream end of the conical section to prevent escape of one or more of air, vaporized aerosol-forming substrate and aerosol between the aerosol-generating article and the mouthpiece, after the aerosol-generating article has been inserted into the cavity of the mouthpiece.

The inner diameter of the cavity adjacent the upstream end of the mouthpiece may be larger than the outer diameter of the aerosol-generating article. This diameter may ease insertion of the aerosol-generating article.

A minimum inner diameter of the conical section may be smaller than an outer diameter of the aerosol-generating article. In embodiments of the invention where the inner diameter of the hollow tubular filter portion is between 2 millimeters and 5 millimeters, the mouthpiece preferably comprises a reduction of its inner diameter to between about 0.7 and 1.5 millimeters. Such a reduction of the inner diameter of the mouthpiece may to create the pin-hole effect that helps determining the aerosol. Such a reduction of the inner diameter of the mouthpiece may also contribute to a target resistance to draw of the aerosol-generating article.

Preferably, the minimum inner diameter of the conical section is reached at the downstream end of the cavity, more preferably at the downstream end of the conical section of the cavity. During insertion of the aerosol-generating article, the outer perimeter of the aerosol-generating article may come into contact with the inner wall of the cavity so that the outer perimeter of the aerosol-generating article may be squeezed together during insertion of the aerosol-generating article into the cavity of the mouthpiece.

The mouthpiece may comprise a stop configured for limiting insertion of the aerosol-generating article into the cavity.

The stop may be provided at the downstream end of the cavity. The stop may be configured as a wall that extends essentially perpendicular to the longitudinal axis of the mouthpiece. The stop may comprise a sealing element such as an O-ring.

The mouthpiece may comprise a downstream end and a venturi section extending from the downstream end in an upstream direction.

The mouthpiece may comprise a central airflow channel. The central airflow channel may be shaped to form the venturi section. The central airflow channel may be arranged along the longitudinal axis of the mouthpiece so that, after insertion of the hollow tubular filter portion of the aerosol-generating article into the cavity of the mouthpiece, the longitudinal axis of the aerosol-generating article may align with the longitudinal axis of the mouthpiece. In other words, after connecting the aerosol-generating article to the mouthpiece, the central airflow channel of the mouthpiece may be aligned with the aerosol-generating article such that air may be drawn through the aerosol-generating article and into the central channel of the mouthpiece. When an aerosol-generating article is inserted into the cavity of the mouthpiece, the venturi section may directly abut the aerosol-generating article.

The venturi section may be conical, wherein an inner diameter of the venturi section increases towards the downstream end of the mouthpiece. Where a pin-hole type constriction of the inner diameter of the mouthpiece is present, the conical section is arranged adjacent and downstream of that constriction of the inner diameter of the mouthpiece. An optimized Venturi effect may be realized by the small diameter in the hollow tubular filter portion of the aerosol-generating article in direct abutment with the venturi section. Air flowing through the aerosol-generating article and particularly the substrate portion of the aerosol-generating article in a downstream direction will enter the small diameter hollow tubular filter portion. After passing the hollow tubular filter portion, the air containing vaporized aerosol-forming substrate will stream into the venturi section and expand after the constriction (either constricted by the small inner diameter of the hollow tubular filter section or constriction in the mouthpiece). As a reaction, the air will cool and aerosol droplets will form in the air. Hence, by providing an aerosol-generating article with a hollow tubular filter portion at the downstream end with a small inner diameter and a mouthpiece with a venturi section in direct abutment to the hollow tubular filter portion, a simple aerosol-generating article may be provided with optimized aerosol generation in the venturi section of the mouthpiece.

A conical angle of the venturi section may be between 0 degrees to 20 degrees, preferably between 4 degrees to 10 degrees, more preferably around 6 degrees. The conical angle may be measured between the longitudinal axis of the mouthpiece and an angled inner wall of the venturi section.

The maximum inner diameter of the venturi section of the mouthpiece and the inner diameter of the hollow tubular filter portion of the aerosol-generating article may be configured such that air containing vaporized aerosol-forming substrate being drawn from the hollow tubular filter portion into the venturi section may be subject to a temperature drop. The initial temperature may be around 250 degrees Celsius. The temperature drop may be between 50 degrees Celsius and 150 degrees Celsius, preferably between 75 degrees Celsius and 125 degrees Celsius, more preferably around 100 degrees Celsius. The temperature may drop to around 160 degrees Celsius. The temperature may further decrease towards the downstream end of the venturi section. Aerosol may thus form in the venturi section. The temperature may be, at the downstream end of the venturi section, between 40 degrees Celsius to 70 degrees Celsius, preferably between 50 degrees Celsius and 60 degrees Celsius.

The airflow channel of the mouthpiece may have a minimum diameter that is larger than the inner diameter of the hollow tubular filter portion of the aerosol-generating article.

In this way, it is guaranteed that the air will expand in the venturi section when flowing into the venturi section from the hollow tubular filter portion and that thereby aerosol will be generated.

The minimum diameter of the airflow channel may be at least 2 millimeters, preferably at least 3 millimeters, more preferably at least 4 millimeters. To enable expansion of the air entering the venturi section from the hollow tubular filter portion, the minimum diameter of the venturi section is equal to or larger than the inner diameter of the hollow tubular filter portion. The minimum diameter of the venturi section may be 1 millimeters larger, preferably 2 millimeters larger, most preferred 3 millimeters larger than the inner diameter of the hollow tubular filter portion.

As used herein, the term 'aerosol-generating article' refers to an article comprising an aerosol-forming substrate that is capable of releasing volatile compounds that can form an aerosol, typically under the application of heat, that is, above room temperature. The aerosol-generating article may be disposable.

The aerosol-generating article may be substantially cylindrical in shape. However, alternatively other cross sections may be used. Indeed, the cross section of the aerosol-generating article may vary along its length, for example by varying the shape of the cross section or the cross sectional dimensions. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between 30 millimeters and 60 millimeters, preferably between 40 millimeters and 50 millimeters, more preferably 45 millimeters. The aerosol-generating article may have an external diameter between approximately 4 millimeters and 8 millimeters, preferably between 5 millimeters and 6 millimeters, more preferably around 5.3 millimeters. In one embodiment, the aerosol-generating article has a total length of approximately 45 millimeters. Further, the aerosol-forming substrate may have a length of between 20 millimeters and 55 millimeters. The aerosol-generating article may comprise an outer wrapper, preferably an outer paper wrapper.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of the aerosol-generating article or smoking article.

The aerosol-forming substrate is a substrate capable of releasing volatile compounds that can form an aerosol. The volatile compounds may be released by heating the aerosol-forming substrate. The aerosol-forming substrate may comprise nicotine. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material, including homogenized tobacco, for example made by, for example, a paper making process or a casting process.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are for example: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The invention further relates to an aerosol-generating device comprising a mouthpiece as described herein. The aerosol-generating device may comprise a housing, electric circuitry, a power supply, a heating chamber and a heating element.

As used herein, an 'aerosol-generating device' relates to a device that interacts with an aerosol-forming substrate to generate an aerosol. The aerosol-forming substrate may be part of the aerosol-generating article. An aerosol-generating device may be a device that interacts with an aerosol-forming substrate of the aerosol-generating article to generate an aerosol.

The electric circuitry may comprise a microprocessor, which may be a programmable microprocessor. The microprocessor may be part of a controller. The electric circuitry may comprise further electronic components. The electric circuitry may be configured to regulate a supply of power to the heating element. Power may be supplied to the heating element continuously following activation of the system or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The device may comprise a power supply, typically a battery, within the main body. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to create an aerosol for multiple puffs.

The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The heating element may be arranged inside or around the heating chamber for heating an aerosol-generating article insertable into the heating chamber. The heating chamber may be a cavity. Alternatively, or in addition, an internal heating element may be provided, for example a pin or a blade that is inserted for use at least partly into the aerosol-forming substrate.

For example, the device may include an external heating element positioned around a perimeter of the heating chamber. An external heating element may take any suitable form. For example, an external heating element may take the form of one or more flexible heating foils on a dielectric substrate, such as polyimide. The flexible heating foils can be shaped to conform to the perimeter of the heating chamber. Alternatively, an external heating element may take the form of a metallic grid or grids, a flexible printed circuit board, a moulded interconnect device (MID), ceramic heating element, flexible carbon fibre heating element or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation. The heating element may be configured to heat to a temperature of around 250 degrees Celsius.

The invention also relates to a method for attaching an aerosol-generating article comprising a hollow tubular filter portion with an inner diameter of below 5 millimeters to a mouthpiece.

Features described in relation to one aspect may equally be applied to other aspects of the invention.

Figure 2:
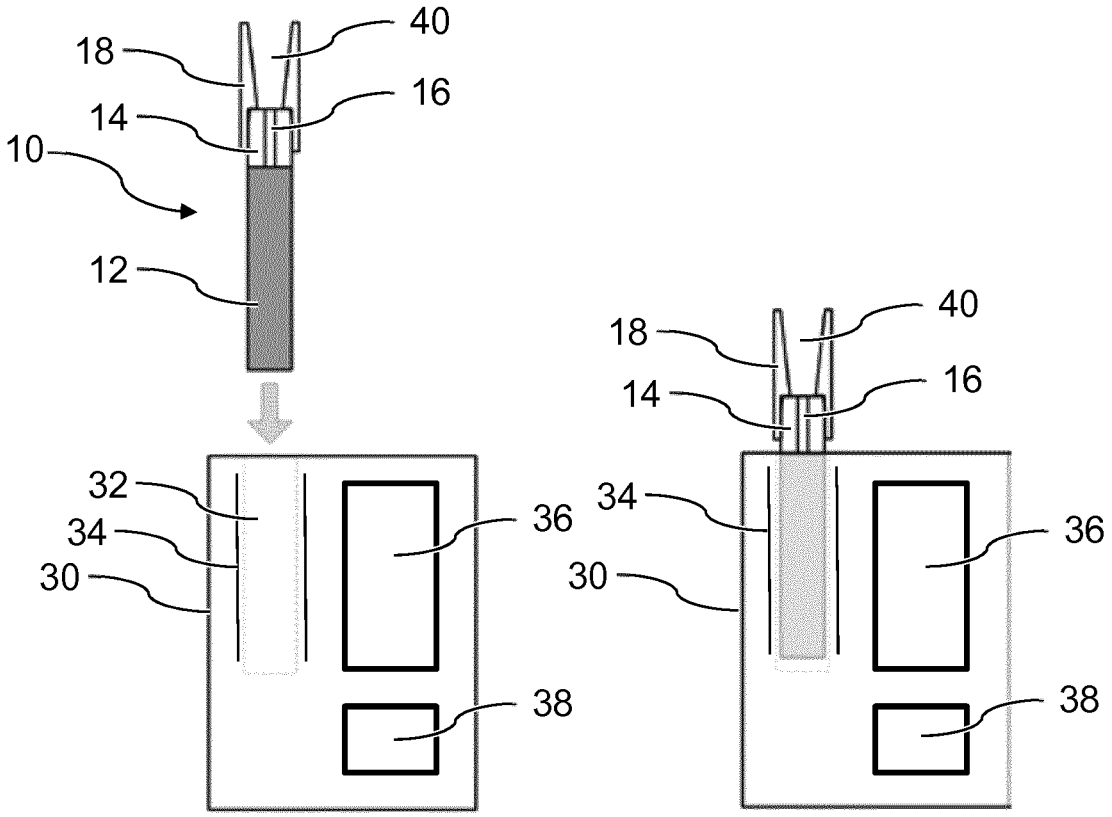

The invention will be further described, by way of example only, with reference to the accompanying drawings in which:

FIG. 1 shows an aerosol-generating article comprising a hollow tubular filter portion with a small-diameter and a mouthpiece for attachment with the aerosol-generating article; and FIG. 2 shows the aerosol-generating article with attached mouthpiece as well as an aerosol-generating device for insertion of the aerosol-generating article.

FIG. 1 shows an aerosol-generating article 10 comprising a substrate portion 12 containing aerosol-forming substrate. Downstream of the substrate portion 12 on the right part of the aerosol-generating article 10 shown in FIG. 1, a hollow tubular filter portion 14 is provided. The hollow tubular filter portion 14 has a hollow central space 16. The hollow central space 16 has a relatively small inner diameter of below 2 millimeters, preferably of around 1 millimeters.

The top part of FIG. 1 shows the aerosol-generating article 10 as well as a detached mouthpiece 18. The mouthpiece 18 comprises a cavity 20 for insertion of the aerosol-generating article 10 into the cavity 20. The cavity 20 has an upstream end 22 facing the aerosol-generating article 10. The upstream end 22 of the cavity 20 has a diameter which is larger than the outer diameter of the aerosol-generating article 10 such that the aerosol-generating article 10 can easily be inserted into the cavity 20. The cavity 20 has a conical section 24 at a downstream end 26 of the cavity 20 such that the aerosol-generating article 10 inserted into the cavity 20 is compressed and thus tightly received in the cavity 20 once fully inserted into the cavity 20. At a downstream end 26 of the cavity 20, the cavity 20 comprises a stop 28 to prevent over insertion of the aerosol-generating article 10.

The bottom part of FIG. 2 shows the aerosol-generating article 10 attached with the mouthpiece 18 after insertion of the aerosol-generating article 10 into the cavity 20 of the mouthpiece 18.

FIG. 2 shows the aerosol-generating article 10 connected with the mouthpiece 18 and in addition an aerosol-generating device 30. In the left part of FIG. 2, the aerosol-generating article 10 has been inserted into the cavity 20 of the mouthpiece 18 thereby establishing a connection between the aerosol-generating article 10 and the mouthpiece 18. However, the aerosol-generating article 10 and the mouthpiece 18 are not yet inserted into the aerosol-generating device 30. In the right part of FIG. 2, the aerosol-generating article 10 is inserted into the aerosol-generating device 30.

The aerosol-generating device 30 comprises a heating chamber 32 for insertion of the aerosol-generating article 10. A heating element 34 is arranged in or surrounding the heating chamber 32 for heating the aerosol-forming substrate contained in the aerosol-generating article 10 for generating an inhalable aerosol. The aerosol-generating device 30 may comprise further components such as a power supply 36 for supplying electrical energy to the heating element 34 as well as electric circuitry 38 for controlling the supply of electrical energy from the power supply 36 to the heating element 34.

The right part of FIG. 2 shows the mouthpiece 18 not in direct attachment with the aerosol-generating device 30. However, if desired, upon insertion of the aerosol-generating article 10 into the aerosol-generating device 30, the mouthpiece 18 may contact the aerosol-generating device 30 so that the aerosol-generating article 10 may be fully surrounded by the heating chamber 32 of the aerosol-generating device 30 as well as the mouthpiece 18. In this way, air may be prevented from entering or exiting between the mouthpiece 18 and the aerosol-generating device 30. In such a configuration, the aerosol-generating device 30 preferably comprises an air inlet for enabling ambient air to enter the heating chamber 32. When a user puffs on the mouthpiece 18, air is preferably drawn from the ambient air through the air inlet into the heating chamber 32 and further through the aerosol-generating article 10 towards the mouthpiece 18 and a mouth of a user.

Alternatively, a gap may be provided between the mouthpiece 18 and the aerosol-generating device 30 as shown in FIG. 2 so as to enable additional airflow into the aerosol generating device. As a further alternative, the aerosol-generating article 10 may be wrapped with a wrapper which essentially prevents air from entering or exiting the inner of the aerosol-generating article 10 from/to the outside through the wrapper even if a gap is provided between the mouthpiece 18 and the aerosol-generating device 30. Hence, a gap may be provided between the mouthpiece 18 and the aerosol-generating device 30, while air is limited to substantially flow only through the aerosol-generating article 10 along the longitudinal axis of the aerosol-generating article 10.

The mouthpiece 18 shown in FIGS. 1 and 2 comprises a venturi section 40, and the inner diameter of the venturi section 40 increases towards the downward end of the mouthpiece 18. Together with the small-diameter of the hollow tubular filter portion 14 of the aerosol-generating article 10, optimized aerosol may be generated in the mouthpiece 18. In this regard, the inner diameter of the hollow tubular filter portion 14 is smaller than the smallest inner diameter of the venturi section 40 of the mouthpiece 18. Hence, if air containing vaporized aerosol-forming substrate flows from the aerosol-generating article 10, more precisely the hollow tubular filter portion 14 of the aerosol-generating article 10, to the mouthpiece 18, the air expands and cools down so that aerosol droplets can form.

The invention claimed is:

1. A system comprising an aerosol-generating article and a mouthpiece configured attachable to the aerosol-generating article, wherein the mouthpiece comprises a venturi section, the aerosol-generating article comprising:

a substrate portion containing aerosol-forming substrate; and a hollow tubular filter portion, wherein the hollow tubular filter portion has an inner diameter of between 0.5 millimeters and 2 millimeters, and wherein the aerosol-forming substrate comprises at least one aerosol-former selected from the group consisting of: polyhydric alcohols, esters of polyhydric alcohols, and aliphatic esters of mono-, di-, or polycarboxylic acids.

2. The system according to claim 1, wherein the aerosol-forming substrate further comprises at least one polyhydric alcohol.

3. The system according to claim 1, wherein the aerosol-forming substrate further comprises triethylene glycol, 1, 3-butanediol, or glycerine.

4. The system according to claim 1, wherein the hollow tubular filter portion has an inner diameter of between 0.75 millimeters and 1.25 millimeters.

5. The system according to claim 1, wherein the hollow tubular filter portion has an inner diameter of around 1 millimeter.

6. The system according to claim 1, wherein the hollow tubular filter portion has an external diameter of between approximately 4 millimeters and approximately 8 millimeters.

7. The system according to claim 1, wherein the hollow tubular filter portion has an external diameter of between approximately 5 millimeters and approximately 6 millimeters.

8. The system according to claim 1, wherein the hollow tubular filter portion is a hollow acetate tube.

9. The system according to claim 1, wherein the hollow tubular filter portion is located downstream of the substrate portion.

10. The system according to claim 9, wherein the hollow tubular filter portion directly abuts the aerosol-forming substrate.

11. The system according to claim 1, further comprising a cylindrical filter portion arranged between the substrate portion and the hollow tubular filter portion.

12. A system for generating an aerosol, comprising:

an aerosol-generating device including a heating chamber and a heating element; and the system according to claim 1, wherein the aerosol-generating article is configured to be insertable into the heating chamber.

13. The system for generating an aerosol according to claim 12, wherein the heating element comprises an external heating element positioned around a perimeter of the heating chamber.

14. The system according to claim 1, wherein the mouthpiece further comprises a downstream end, wherein an inner diameter of the Venturi section increases towards the downstream end, and wherein the Venturi section directly abuts the hollow tubular filter portion when the mouthpiece is attached to the aerosol-generating article.

15. The system according to claim 1, wherein the mouthpiece further comprises an upstream end with a cavity configured to enable insertion of the aerosol-generating article into the cavity.

16. The system according to claim 1, wherein the hollow tubular filter portion of the aerosol-generating article is in direct abutment with the venturi section of the mouthpiece.

* * * * *